United States Patent [19]

Gáspár

[11] Patent Number: 4,658,184

[45] Date of Patent: Apr. 14, 1987

[54] METHOD OF TRIGGERING A HIGH PRESSURE SODIUM VAPOR LAMP AND SODIUM VAPOR LAMP WITH IMPROVED TRIGGERING

[75] Inventor: János Gáspár, Budapest, Hungary

[73] Assignee: Tungsram Reszvenytarsasaq, Budapest, Hungary

[21] Appl. No.: 779,352

[22] Filed: Sep. 23, 1985

[30] Foreign Application Priority Data

Sep. 21, 1984 [HU] Hungary ..... 3570/84

[51] Int. Cl.[4] ..... H01J 7/44

[52] U.S. Cl. ..... 315/47; 313/15; 315/46; 315/50; 315/73; 315/290

[58] Field of Search ..... 315/50, 73, 290, 46, 315/47; 313/15, 17, 44

[56] References Cited

U.S. PATENT DOCUMENTS

| | | | |
|---|---|---|---|
| 3,746,914 | 7/1973 | Olson et al. | 315/47 |
| 3,757,159 | 9/1973 | Gutta | 315/46 |
| 4,520,294 | 5/1985 | Iida et al. | 315/290 |
| 4,567,403 | 1/1986 | Ohtagaki et al. | 315/46 |

*Primary Examiner*—Harold Dixon

*Attorney, Agent, or Firm*—Karl F. Ross; Herbert Dubno

[57] ABSTRACT

A high vacuum sodium vapor lamp whose discharge tube is surrounded by a heating coil connected in series with a switch opening to interrupt the heating after the lapse of a heating period sufficient to allow breakdown of the tube, is also provided with overvoltage protection and especially an element located in the lamp base, for limiting the autoinductive voltage poles to a level sufficient for breakdown of the tube but insufficient to allow breakdown between the terminals of the lamp.

14 Claims, 5 Drawing Figures

METHOD OF TRIGGERING A HIGH PRESSURE SODIUM VAPOR LAMP AND SODIUM VAPOR LAMP WITH IMPROVED TRIGGERING

FIELD OF THE INVENTION

My present invention relates to high pressure sodium vapor lamps and, more particularly, to an improved method of triggering a high pressure sodium vapor lamp and, of course, to a sodium vapor lamp having improved triggering means.

BACKGROUND OF THE INVENTION

A high pressure sodium vapor lamp generally comprises an arc or discharge tube mounted within a light-transmissive envelope provided with a base forming two electrical connectors or terminals for a circuit adapted to receive this base, the electrical connectors being internally connected to the arc tube. The latter contain elemental sodium and can be provided with a heating body which can be a coil surrounding this tube and connected electrically in parallel with the tube to the connectors or terminals formed by the base.

It is desirable, and one of the objects of the invention as detailed below, to be able to operate the high pressure sodium vapor lamp at feed voltages in excess of 100 V but without separate starters or igniters, neglecting the input or intrinsic starting inductivity as a source of the arc-firing voltage.

There are various techniques for firing a high pressuring sodium lamp without using separate igniters. For example, one such system is described in U.S. Pat. No. 3,721,846 (see also U.S. Pat. No. 3,721,845) in which a heating body in the form of a coil surrounds the arc tube and is electrically connected to the terminals so that the arc tube can be heated and at least part of the sodium provided therein, transformed into the vapor state so that the ignition voltage of the sodium lamp is reduced and the latter thereby rendered more readily startable.

This technique for starting a sodium lamp has the disadvantage that the heating wire, for ignition exclusively by the line voltage utilizing the heating effect, must be brought to a comparatively high temperature so that its useful life is drastically limited. Furthermore, the elements to which the heating wire coiled around the arc tube may be connected, must be designed in light of the high degree of thermal expansion, thereby increasing the assembly costs. It is also a disadvantage that the switch which is used to interrupt the heating occuring in these systems, generally utilizing a bimetallic element as the acting switch member and hereinafter referred to as a bimetal, operates in the vacuum of the envelope surrounding the discharge tube and, in the event that ignition of the arc tube does not occur at the appropriate time (e.g. because of a momentary failure of ignition conditions and contact failures of the support fixtures in the arc lamp or a return of the arc tube to a nonexcited or base state) the autoinductive shock which can be generated can be comparatively high (e.g. of the order of 8 to 10 kV) upon opening of the vacuum switch and sufficient to damage the lamp or the accessories with which it is used and can even result in fire.

It is also known to provide arc tubes which are ignited by the generation of a high autoinductive voltage. One such approach is found, for example, in Geramn patent DE-PS No. 1 589 162. The disadvantage of this system lies in the comparative unreliability of the ignition since, when the switch interruption coincides substantially with a zero passage of the sine wave of the supply voltage, no autoinductive voltage is generated by operation of the switch and ignition cannot occur.

Capacitative ignition systems are also known as is, for example, described in U.S. Pat. No. 4,037,129. A disadvantage of this system is that with a supply voltage of 220 V, the arc tube cannot be ignited in a sodium vapor lamp having the usual zenon filling gas. In such cases it is necessary to utilize a Penning mixture as the filling gas, thereby reducing the operating life of the lamp and having a detrimental effect on the light output thereof.

OBJECTS OF THE INVENTION

It is the principal object of the present invention to provide an improved method of igniting the triggering or starting a high pressure sodium vapor lamp whereby the drawbacks of earlier methods are avoided.

It is another object of this invention to provide a more easily ignitable high pressure sodium vapor lamp which can be operated with greater reliability and has a higher luminous output and greater useful life than earlier sodium vapor lamps.

It is also an object of this invention to provide a method of triggering a high pressure sodium vapor lamp which allows triggering at the operating or line voltage which may be above 100 volts, without special triggering devices and which is more reliable than earlier systems and thereby retains the advantages of conventional systems as described while being free from the disadvantages thereof.

SUMMARY OF THE INVENTION

These objects and others which will become apparent hereinafter are attained, in accordance with the invention, in a method of triggering a high pressure sodium vapor lamp having an arc tube whose terminals are connected to the terminals of the lamp base and which is provided with a heating body connected electrically in parallel with the arc tube and in which initially the arc tube and the heating body are energized in parallel to heat the arc tube and cause at least some vaporization of the sodium therein.

According to the invention, a switch in series with the heating body is opened to interrupt the heating current so that the heating is only efefctive for triggering the arc tube. The switch provided for interrupting the current also generates a voltage pulse attributable to the intrinsic starting or input inductivity to excite the sodium lamp, while an overvoltage protection is provided between the input conductors of the lamp to limit the voltage which is generated to one which is less than the breakdown voltage between these conductors and the associated fittings of the sodium lamp, e.g. the terminals formed by the base of the latter and its circuit, but which is yet sufficient to ignite the sodium vapor arc at the temperature to which the arc tube has been heated.

According to the invention, therefore, three conditions occur simultaneously for ignition. These three conditions are:

A. The breakdown voltage of the arc tube, namely the space between the electrodes in which sodium vapor has been generated by heating at the elevated pressure of the sodium vapor resulting from this heating, is now reduced.

B. Since the current of the input inductivity is interrupted, a selfinduction or autoinduction voltage appears across the poles or the electrodes of the arc lamp which exceeds the operating voltage and can break down this gas space.

C. The reliability of the heating of the arc tube by the heating body is improved by providing the latter on or immediately adjacent the arc tube.

As a consequence of the latter point and the manner in which the heating body is connected, it will be apparent that the heating body also functions in part as a capacitative ignition electrode which is open circuited at one end by the temperature-controlled switch.

As a consequence, the sodium vapor lamp is triggered or ignited with complete reliabilty while the overload protection prevents the detrimental effects of high voltage spikes generated by arc lamps from having the disadvantages outlined previously.

One system for providing overvoltage protection in accordance with the invention is to provide the switch in a gas space whose pressure exceeds 0.1 bar so that a breakdown or arc can be generated across the contacts of this switch even when this switch is opened should an excessive voltage be generated. The switch is preferably a bimetallic switch with one of these contacts being a bimetal.

The overload protection can be additionally or alternatively provided by a voltage dependent element, such as a voltage dependent resistor or spark gap, preferably connected in the base of the lamp directly between the terminals of the latter so that the leads to the arc tube are connected directly to the leads of the voltage dependent element.

It is of the utmost importance, when the overvoltage protection is a voltage-dependent element of the type described, to provide this element directly to the supply terminals of the lamp, i.e. at the base since any other location or connection of the element may render the latter ineffective by interruption of a connection or may render the latter incapable of responding sufficiently rapidly to a high voltage pulse and thereby prevent damage to the lamp fittings.

BRIEF DESCRIPTION OF THE DRAWING

The above and other objects, features and advantages of the present invention will become more readily apparent from the following description, references being made to the accompanying drawing in which.

SPECIFIC DESCRIPTION

Figure 1:
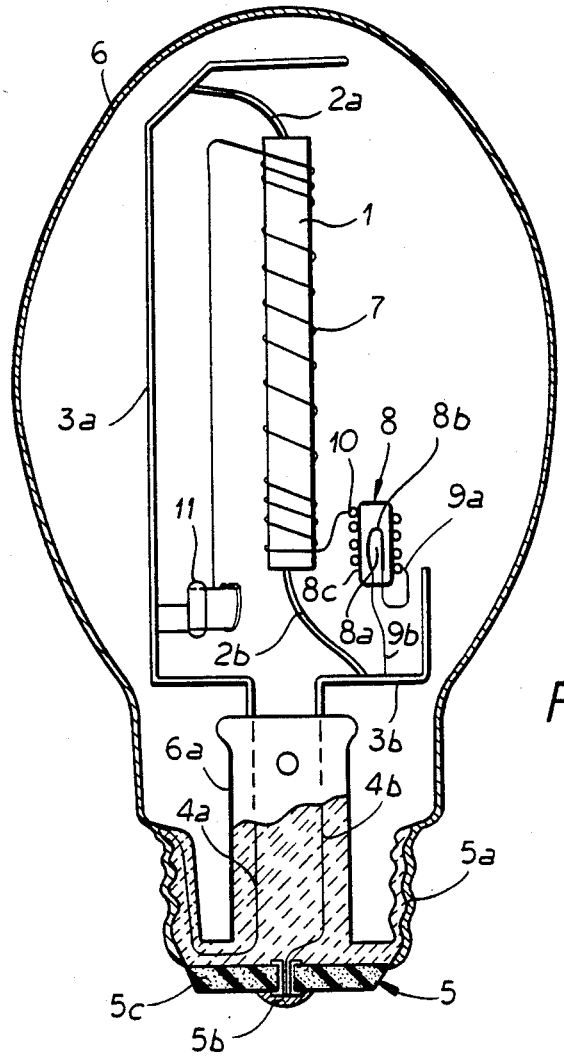
FIG. 1 is an axial cross sectional view through a high pressure sodium vapor lamp to which the staring method of the invention is applicable and utilizing a bimetal switch in a gas space.
Figure 2:
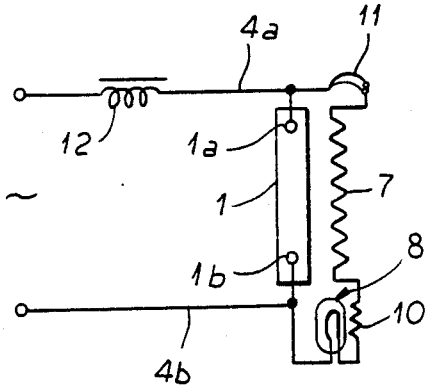
FIG. 2 is a circuit diagram of the sodium vapor lamp of FIG. 1.

In FIG. 1 of the drawing, I have shown a high pressure sodium vapor lamp (see also the aforementioned U.S. patents) which comprises an arc tube 1 whose electrodes have been diagrammatically illustrated at 1*a* and 1*b* in FIG. 2 and which are connected by leads 2*a* and 2*b* to the support armatures, fittings or brackets 3*a* and 3*b* carrying the arc tube whose electrodes have been diagrammatically illustrated at 1*a* and 1*b* at FIG. 2 and which are connected by leads 2*a* and 2*b* to the support armatures, fittings or brackets 3*a* and 3*b* carrying the arc tube 1.

The bracket 3*a* and 3*b* are electrically conductive strips of metal and are connected to the leads or conductors 4*a* and 4*b* of the lamp base 5 which comprises a male-threaded metal cup 5*a* and a pin 5*b* insulated by a disc 5*c* from the cup 5*a*.

The envelope 6 of the lamp, which is evacuated, is sealed to the cup 5*a* and the disc 5 and forms a post 6*a* supporting the fittings 3*a* and 3*b* previously described.

A heating body in the form of a coil 7 of a refractory metal generating heat upon energization by the alternating current source through the terminals formed by the base elements 5*a* and 5*b* is wound around the arc tube 1 as shown and is connected in series with a switch 8 whose leads have been represented at 9*a* and 9*b* in FIG. 1.

The switch 8, in turn, has a heating body wound therearound in the form of a coil 10 which is connected in series with the coil 7 and with the switch contacts 8*a* nd 8*b*, the former of which is a bimetal.

In addition, the other end of the heating body 7 is in series with a bimetallic switch 11 mounted on the bracket 3*a*. While the switch 11 is exposed to the vacuum in the envelope 6, the switch 8 is isolated from this vacuum by a sealed envelope 8*c* filled with gas so that the contacts 8*a* and 8*b* lie in a gas space.

The sodium vapor lamp shown in FIG. 1 and whose eqivalent circuit has been illustrated in FIG. 2 is operated as follows: When the line voltage is supplied, both switches 8 and 11 are in their closed states so that the supply current flows through a circuit consisting of the distributed intrinsic input or starting inductivity (Vorlageinduktivität) for convenience illustrated as a 12 in FIG. 2, the lead 4*a* sodium vapor lamp, support bracket 3*a*, the switch support, the heating body 7 wound on the discharge tube 1, the heating body 10 of the switch 8, the support bracket 3*b* and the lead 4*b* of the lamp. The line voltage is applied across the electrodes of the arc tube 1.

Upon the conclusion of the heating period (which is established by the dimensioning of the heating bodies and generally is between 1 and 2 minutes) the switch 8 opens.

At the instant of opening of this switch, the discharge which results from the aforementioned three factors is established through tube 1.

By the constructive configuration of the gas filled switch 8 (elasticity of the bimetal, construction and the gas filling) the characteristic induction voltage is limited, since it can jump the contacts in this switch, so that it is less than the breakdown voltage across the brackets 3*a* and 3*b* of the lamp. The switch 11 serves to break the connection to the other end of the heating body 7 in the heated state, thereby preventing sodium ions from migrating to the wall of the discharge tube and there recombining so that they tend to lodge in the ceramic materials of this wall and in this manner prematurely restore the discharge tube to its base level with respect to the degree of ignition.

Figure 3:
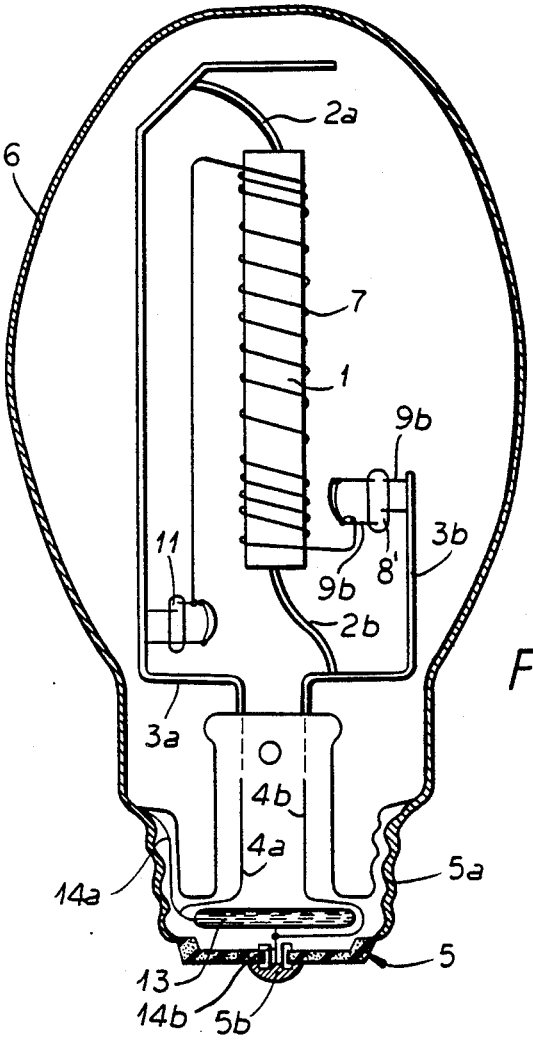
FIG. 3, is a view of a lamp similar to that of FIG. 1 utilizing a voltage-dependent resistor as the overvoltage protection element.
Figure 4:
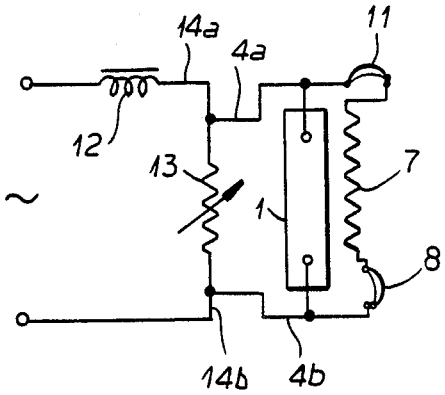
FIG. 4 is a circuit representing the connection of the lamp of FIG. 3.

The sodium vapor lamp as illustrated in FIG. 3, and whose equivalent circuit has been shown in FIG. 4, differs from the previously described embodiment in that the switch 8' equivalent to the switch 8, is not provided in a gas space but is found in the vacuum within the envelope 6. In this case the overvoltage protection is provded by the voltage-dependent resistor 13 which is connected directly as shown between the terminals 5a and 5b formed by the base of the lamp. The sodium lamp in these figures is triggered in the following manner;

Application of the supply voltage finds the switches 8' and 11 in closed states so that the starting current flows through the input inductivity 12, the lead 14a of the voltage-dependent resistor 13, the lead 4a of the lamp, the support bracket 3a, the switch 11, the heating body 7, the switch 8, the support bracket 3b and the lead 14b of the voltage-dependent resistor 13 which lies in parallel to the arc tube 1.

Upon the lapse of the corresponding heating period which is determined by the dimensioning of the heating body 7 and the switch 8' and its location relative to the heating body 7, usually between one and two minutes, the switch 8' opens.

At the instant of opening of this switch, the discharge is generated in the tube 1 in the manner described although in this case the autoinduction voltage is limited by the voltage-dependent resistor 13.

Because the leads 14a and 14b of the voltage-dependent resistor 13 are directly connected to the lamp base 5, with the leads 4a and 4b of the lamp, solder junctions or weld jucntions are not affected by overload and high reliability is ensured.

Figure 5:
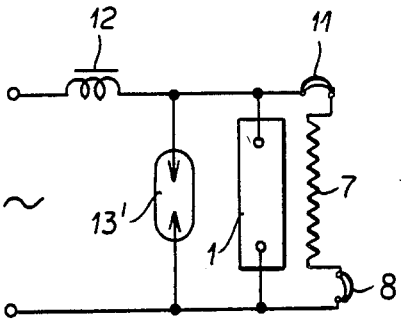
FIG. 5 is a circuit diagram similar to FIG. 4 showing a spark cap as the overvoltage protective element.

In the modification of FIG. 5, the spark gap 13' replaces the voltage-dependent resistor 13, the lamp being otherwise operated in the manner described.

I claim:

1. A method of triggering a high vacuum sodium vapor lamp having a discharge tube connected to a pair of lamp terminals, and a heating body in heat transfer relationship with said tube, and connectable to said terminals in parallel with said tube and in series with an input inductivity, said method comprising the steps of:

connecting said terminals to a source of line current, thereby electrically energizing said body and heating said tube to reduce a breakdown voltage thereof while applying line voltage across said tube;

upon the lapse of a heating period, disconnecting said heating body at least at one side thereof in response to temperature to open-circuit said side of said body and generate an autoinductive pole sufficient to effect breakdown in said tube and thereby ignite the latter; and limiting the voltage generated upon open-circuiting of said side of said body to a level sufficient to effect discharge in said tube at the temperature to which said tube has been heated by said body, but to a level less than the breakdown voltage between said terminals.

2. The method defined in claim 1 wherein the voltage is limited by providing a spark discharge path traversed by a spark in the vent an overvoltage is generated across said terminals.

3. The method defined in claim 1 wherein said voltage is limited by connecting a voltage-limiting element directly across said terminals in a base of said lamp provided with said terminals.

4. The method defined in claim 1 wherein said voltage is limited by connecting a voltage-dependent resistor across said terminals.

5. The method defined in claim 1 wherein said body is open circuited at said side by thermally activating a bimetallic switch connected in series with said side.

6. The method defined in claim 5 wherein said switch has contacts disposed in a gas space.

7. A high pressure sodium vapor lamp which comprises:

an evacuated light-transmissive envelope;

a base formed on said envelope and provided with a pair of terminals connectable to a line current source;

a sodium-containing discharge tube mounted in said envelope and having respective electrodes connected respectively to said terminals whereby said tube can be energized by said source through an input inductivity;

a heating body wound on said tube and connected electrically in series with said input inductivity and with said terminals in parallel to said tube;

a thermally responsive switch in series with one side of said body and one of said terminals and responsive to the heating of said tube by said body for deenergizing said body upon the lapse of a predetermined starting period within which said tube is heated sufficiently to enable breakdown by an autoinduction voltage pulse generated upon open circuiting of said body; and means connected to said terminals for limiting the voltage supplied in said poles to a voltage sufficient to effect discharge in said tube but less than a breakdown voltage across said terminals.

8. The lamp defined in claim 7 wherein said switch has a pair of contacts including at least on bimetal.

9. The lamp defined in claim 8 wherein said contacts are disposed in said envelope and subjected to high vacuum thereof, said means including an overvoltage protective element received in said base.

10. The lamp defined in claim 9 wherein said element is a voltage-dependent resistor connected across said terminals in said base.

11. The lamp defined in claim 9 wherein said element is a spark gap.

12. The lamp defined in claim 8 wherein said contacts are received in a gas-containing vessel whereby a discharge across said contacts limits the voltage of said pulse.

13. The lamp defined in claim 12 wherein said vessel is provided with a heating coil connected in series with said heating body.

14. The lamp defined in claim 7, further comprising a bimetallic switch in series with an opposite side of said body and the other of said terminals.

* * * * *